US008703374B2

(12) United States Patent
Sweeney et al.

(10) Patent No.: US 8,703,374 B2
(45) Date of Patent: Apr. 22, 2014

(54) TONER COMPOSITION WITH CHARGE CONTROL AGENT-TREATED SPACER PARTICLES

(75) Inventors: Maura A. Sweeney, Irondequoit, NY (US); Robert D. Bayley, Fairport, NY (US); Grazyna E. Kmiecik-Lawrynowicz, Fairport, NY (US); Anne Marie Sweeney-Jones, Irondequoit, NY (US)

(73) Assignee: Xerox Corporation, Norwalk, CT (US)

( * ) Notice: Subject to any disclaimer, the term of this patent is extended or adjusted under 35 U.S.C. 154(b) by 140 days.

(21) Appl. No.: 13/416,674

(22) Filed: Mar. 9, 2012

(65) Prior Publication Data

US 2013/0236825 A1 Sep. 12, 2013

(51) Int. Cl.
*G03G 9/093* (2006.01)
*G03G 9/097* (2006.01)

(52) U.S. Cl.
USPC ..... 430/108.11; 430/108.3; 430/108.4; 430/108.5; 430/110.2; 430/137.14; 430/137.11

(58) Field of Classification Search
USPC ..... 430/108.4, 108.3, 108.2, 108.5, 110.3, 430/137.11, 137.14, 108.11, 110.2
See application file for complete search history.

(56) References Cited

U.S. PATENT DOCUMENTS

| | | | | |
|---|---|---|---|---|
| 3,590,000 | A | | 6/1971 | Palermiti et al. |
| 3,800,588 | A | | 4/1974 | Larson et al. |
| 3,847,604 | A | | 11/1974 | Hagenbach et al. |
| 3,944,493 | A | | 3/1976 | Jadwin et al. |
| 4,007,293 | A | | 2/1977 | Mincer et al. |
| 4,079,014 | A | | 3/1978 | Burness et al. |
| 4,295,990 | A | | 10/1981 | Verbeek et al. |
| 4,298,672 | A | | 11/1981 | Lu |
| 4,338,390 | A | | 7/1982 | Lu |
| 4,394,430 | A | | 7/1983 | Jadwin et al. |
| 4,560,635 | A | | 12/1985 | Hoffend et al. |
| 4,935,326 | A | | 6/1990 | Creatura et al. |
| 4,937,166 | A | | 6/1990 | Creatura et al. |
| 5,213,933 | A | * | 5/1993 | Osaki et al. ..... 430/108.2 |
| 5,236,629 | A | | 8/1993 | Mahabadi et al. |
| 5,290,654 | A | | 3/1994 | Sacripante et al. |
| 5,302,486 | A | | 4/1994 | Patel et al. |
| 5,330,874 | A | | 7/1994 | Mahabadi et al. |
| 5,683,845 | A | * | 11/1997 | Sata et al. ..... 430/109.4 |
| 5,763,132 | A | * | 6/1998 | Ott et al. ..... 430/137.18 |
| 6,063,827 | A | | 5/2000 | Sacripante et al. |
| 6,214,507 | B1 | | 4/2001 | Sokol et al. |
| 6,300,031 | B1 | * | 10/2001 | Kato et al. ..... 430/137.2 |

(Continued)

FOREIGN PATENT DOCUMENTS

| | | | | |
|---|---|---|---|---|
| EP | 197242 A2 | * | 10/1986 | ..... C08G 59/14 |
| EP | 558046 A1 | * | 9/1993 | ..... G03G 9/097 |
| JP | 2006091648 A | * | 4/2006 | |

OTHER PUBLICATIONS

English language machine translation of JP 2006-091648 (Apr. 2006).*

(Continued)

*Primary Examiner* — Christopher Rodee
(74) *Attorney, Agent, or Firm* — Oliff PLC

(57) ABSTRACT

Toner particles include a shell and a core, wherein the shell includes charge control agent-treated spacer particles that cause protrusions from the toner particle surface.

13 Claims, 1 Drawing Sheet

(56) References Cited

U.S. PATENT DOCUMENTS

| | | | | |
|---|---|---|---|---|
| 6,566,025 | B1 * | 5/2003 | McStravick et al. | 430/108.11 |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,141,761 | B1 | 11/2006 | Dirubio et al. | |
| 7,452,646 | B2 | 11/2008 | Hu et al. | |
| 7,833,684 | B2 | 11/2010 | Lincoln et al. | |
| 2002/0064723 | A1 * | 5/2002 | Nanya et al. | 430/108.22 |
| 2004/0053154 | A1 * | 3/2004 | Tomita et al. | 430/109.4 |
| 2004/0137352 | A1 | 7/2004 | McStravick et al. | |
| 2005/0119487 | A1 * | 6/2005 | Ueno et al. | 546/336 |
| 2006/0154168 | A1 * | 7/2006 | Tomita et al. | 430/109.4 |
| 2006/0160007 | A1 * | 7/2006 | Kmiecik-Lawrynowicz et al. | 430/108.3 |
| 2006/0222991 | A1 | 10/2006 | Sacripante et al. | |
| 2007/0009823 | A1 * | 1/2007 | Skorokhod et al. | 430/108.3 |
| 2007/0065745 | A1 * | 3/2007 | Gerroir et al. | 430/110.2 |
| 2008/0138735 | A1 * | 6/2008 | Tomita et al. | 430/110.4 |
| 2009/0123865 | A1 * | 5/2009 | Sweeney et al. | 430/110.2 |
| 2009/0246669 | A1 * | 10/2009 | Uno | 430/108.2 |
| 2009/0246681 | A1 * | 10/2009 | Kawamura et al. | 430/137.14 |
| 2009/0325101 | A1 * | 12/2009 | Ikami et al. | 430/137.14 |

OTHER PUBLICATIONS

"alkyl". UPAC. Compendium of Chemical Terminology, 2nd ed. (the "Gold Book"). Compiled by A. D. McNaught and A. Wilkinson. Blackwell Scientific Publications, Oxford (1997). XML on-line corrected version: http://goldbook.iupac.org (2006-) created by M. Nic, J. Jirat, B. Kosata; updates compiled by A. Jenkins. ISBN 0-9678550-9-8.*

* cited by examiner

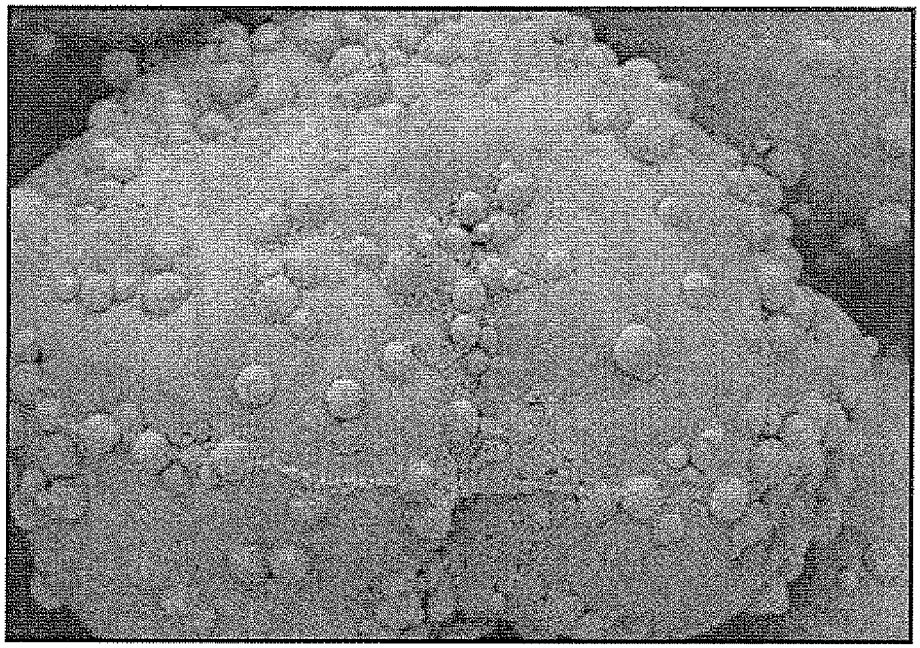

TONER COMPOSITION WITH CHARGE CONTROL AGENT-TREATED SPACER PARTICLES

BACKGROUND

This disclosure is generally directed to toner processes, and more specifically, emulsion aggregation and coalescence processes, as well as toner compositions formed by such processes and development processes using such toners.

Emulsion aggregation/coalescence processes for the preparation of toners are well known.

In a number of electrophotographic engines and processes, toner images may be applied to substrates. The toners may then be fused to the substrate by heating the toner with a contact fuser or a non-contact fuser, wherein the transferred heat melts the toner mixture onto the substrate. However, the quality of developed image may vary depending, amongst others, upon the toner composition properties, the age of the toner (measured in how many print cycles have been completed using the toner composition), and how the toner composition reacts to changes in the operating conditions such as temperature and relative humidity.

Many current toner formulations show charging that is temperature and humidity specific. For example, many toner formulations perform moderately in ambient (70° F./20% RH) and low temperature/low humidity (60° F./10% RH) conditions, but their performance worsens in high temperature/high humidity (80° F./80% RH) conditions. Satisfactory performance at all conditions is desired, because the toner composition can be subjected to a range of different operating conditions, while high print quality is still demanded.

Possible solutions to the above problem have been to incorporate a charge control agent in the toner composition, either by adding a charge control agent as an external additive to the toner particle surface, where the charge control agent is blended on top of the toner particles, or adding the charge control agent directly into the toner particles as an internal additive. However, incorporation into the toner did not enhance the charge sufficiently, and addition as an external additive did not result in consistent charging properties over time as the toner composition ages. Neither approach has provided an effective solution of providing consistent toner particle charging over time.

This problem is in turn aggravated by the increasing demands that are being placed on the toner development process. For example, electrophotographic engines and processes are being implemented that demand higher print counts, where the toner composition has an increased lifetime in taws of the number of imaging cycles. However, for many toner compositions, the demand of higher print counts has resulted in the problem that additive impaction into the surface of the toner particles increases, detracting from the objective of longer print life. As toner ages past 10,000, 20,000, and even 30,000 prints, the additives become impacted in the toner surface to the extent that charges are reduced and print failure increases.

Thus, a need exists for toner compositions that provide more consistent charging properties over the lifetime of the toner. A need also exists for toner compositions in which the additives do not become so impacted into the toner particle surface before the end of life of the cartridge, thereby allowing for better print performance and consistency in all temperature/humidity zones and for improved cartridge life.

SUMMARY

The present disclosure provides a toner particle comprising a shell and a core, wherein the shell comprises charge control agent-treated spacer particles that cause protrusions from the toner particle surface.

The present disclosure also provides a method of making toner particles, the method comprising:

forming a slurry by mixing together a first emulsion containing a resin, optionally a wax, optionally a colorant, optionally a surfactant, optionally a coagulant, and one or more additional optional additives;

heating the slurry to form aggregated particles in the slurry;

forming a shell on the aggregated particles by adding to the slurry a second emulsion comprising a resin;

during the step of forming a shell, adding to the slurry charge control agent-treated spacer particles to form protrusions in the shell;

freezing aggregation of the particles by adjusting the pH;

heating the aggregated particles in the slurry to coalesce the particles into toner particles; and optionally washing and drying the toner particles.

BRIEF DESCRIPTION OF DRAWINGS

The FIGURE is an image of a toner particle according to the present disclosure.

EMBODIMENTS

The present disclosure provides a toner particle comprising a core and a shell, wherein the shell comprises charge control agent-treated spacer particles that cause protrusions from the toner particle surface. The protrusions and presence of the charge control agent-treated spacer particles provide more consistent charging properties over the lifetime of the toner because the charge control agent species remain accessible on the outer surface of the toner particles even when other additives become impacted into the toner particle surface before the end of life of the toner cartridge. The toner particles in embodiments provide better print performance and consistency in all temperature/humidity environments.

The present disclosure also provides a method for making the toner particle, including providing toner particles having a core and having a shell, wherein the shell comprises charge control agent-treated spacer particles that cause protrusions from the toner particle surface.

Processes of the present disclosure may include aggregating particles, such as particles containing crystalline and/or amorphous polymeric resins, such as polyesters, optionally a wax, and optionally a colorant, in the presence of a coagulant. The charge control agent-treated spacer particles are incorporated into the shell at an appropriate time of the shell formation step such that they cause protrusions from the toner particle surface to the desired extent.

A number of advantages are associated with the toner obtained by the processes and toner compositions illustrated herein. For example, the toner particles of the present disclosure may have increased charging performance over a wide range of temperature and humidity environments, such as above about 35 μC/gm in A-zone (80° F., 80-85% relative humidity), above about 65 μC/gm in B-zone (70° F., 50% relative humidity), and above about 85 μC/gm in J-zone (70° F., 10% relative humidity).

The toner particles of the present disclosure may also have an increased lifetime. That is, the toner composition may provide the above increased and more consistent toner particle charging over a larger number of imaging cycles or prints as compared to a conventional toner composition, with the toner particles being protected by the spacer particles from rapid impaction of additives. For example, the toner particles of the present disclosure may have an increased lifetime of more than 20,000 pages, such as at least 30,000, at least 40,000, or at least 50,000 pages or more.

By having the spacer particles protruding on the surface of the toner, the surface area of the toner particle is increased. This is especially helpful for otherwise extremely spherical toner designs, because the presence of the spacer particles lessens the smooth spherical nature of the toner particles and allows for higher surface area and improved cleaning of the toner. In addition, by having the spacer particles on the surface, other additives tend to attach on the less prominent areas of the toner surface, allowing the charging surface to be available at all times. Thus the charging remains consistent throughout the life of the print cycle while the additives do not become impacted before end of life of the cartridge, allowing for better print performance and consistency in all environments and for improved cartridge life.

The toner particles of the present disclosure may also have a different visual morphology as compared to conventional toner. For example, the protrusions resulting from the charge control agent-treated spacer particles may change the toner particle morphology from a relatively smooth surface to a relatively bumpy surface.

Resin

Toners of the present disclosure may include any resin suitable for use in forming a toner. Such resins, in turn, may be made of any suitable monomer. Suitable monomers useful in forming the resin include, but are not limited to, acrylonitriles, dials, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, a suitable toner of the present disclosure may include one or more amorphous polyester resins and a crystalline polyester resin. The weight ratio of the resins may be from about 98% amorphous resins/2% crystalline resin, to about 70% amorphous resins/30% crystalline resin, in embodiments from about 90% amorphous resin/10% crystalline resin, to about 85% amorphous resin/25% crystalline resin.

The resins may be formed by emulsion aggregation methods. Utilizing such methods, the resin may be present in a resin emulsion, which may then be combined with other components and additives to form a toner of the present disclosure.

The resins may be present in an amount of from about 65 to about 95 percent by weight, or from about 70 to about 90 percent by weight, or from about 75 to about 85 percent by weight of the toner particles (that is, toner particles exclusive of external additives) on a solids basis. The ratio of crystalline resin to amorphous resin can be in the range from about 1:99 to about 40:60, such as from about 5:95 to about 35:65, such as from 10:90 to 30:70, such as from about 15:75 to about 30:70, such as from 20:80 to about 25:75, such as from about 25:75 to about 30:70.

Crystalline Resin

When a crystalline resin is used, the crystalline resin may be a polyester resin formed by reacting a diol with a diacid or diester in the presence of an optional catalyst. For forming a crystalline polyester, suitable organic dials include aliphatic dials having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, or from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, from about 40 to about 60 mole percent, in embodiments from about 42 to about 55 mole percent, for example from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), poly(nonylene-dodecanoate) copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

Polycondensation catalysts that may be utilized for the crystalline polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

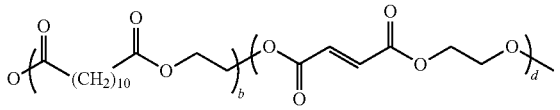

wherein b is from about 5 to about 2000, such as from about 7 to about 1750, in embodiments from about 10 to about 1500; and d is from about 5 to about 2000, such as from about 7 to about 1750, in embodiments from about 10 to about 1500.

The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Amorphous Resin

The amorphous resin may likewise be a polyester resin formed by reacting a diol with a diacid or diester in the presence of an optional catalyst. Suitable catalysts include the above-described polycondensation catalysts.

Examples of diacids or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins that may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula:

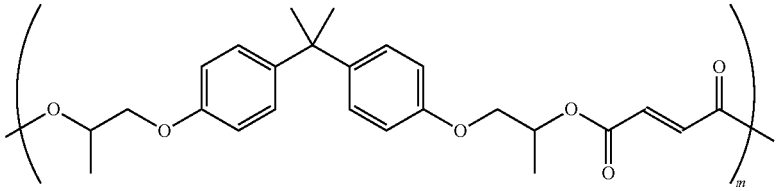

wherein m may be from about 5 to about 1000, such as from about 7 to about 750, in embodiments from about 10 to about 500. Examples of such resins and processes for their production include those disclosed in U.S. Pat. No. 6,063,827, the disclosure of which is hereby incorporated by reference in its entirety.

An example of a linear propoxylated bisphenol A fumarate resin that may be utilized as a resin is available under the trade name SPARII from Resana S/A Industrias Quimicas, Sao Paulo, Brazil. Other propoxylated bisphenol A fumarate resins that may be utilized and are commercially available include GTUF and FPESL-2 from Kao Corporation, Japan, XP777 from Reichhold, Research Triangle Park, N.C. and the like.

In embodiments, a suitable amorphous resin utilized in a toner of the present disclosure may have a weight average molecular weight of from about 10,000 to about 100,000, such as from about 12,000 to about 75,000, in embodiments from about 15,000 to about 30,000.

Toner

The resins of the resin emulsions described above, in embodiments an amorphous polyester resin and a crystalline polyester resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to faint toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polymer binder resin, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resins in forming toner particles. When included, the wax may be present in an amount of, for example, from about 1 weight percent to about 25 weight percent of the toner particles, or from about 2 weight percent to about 25 weight percent, or from about 5 weight percent to about 20 weight percent of the toner particles.

Waxes that may be selected include waxes having, for example, a weight average molecular weight of from about 500 to about 20,000, such as from about 700 to about 15,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Charge Control Agent-Treated Spacer Particles

The toner particles also include charge control agent-treated spacer particles, generally in the toner particle shell, causing protrusions from the toner particle surface. These particles generally comprise spacer particles that are treated with a charge control agent species. The charge control agent species can be either chemically attached or associated with the spacer particles, such as by being attached by covalent bonding or hydrogen bonding or the like, or the charge control agent species can be physically associated with the spacer particles, such as by being physically impacted into or adsorbed onto the spacer particles. Any association can be used, provided the charge control agent species remains available on the spacer particles to provide the desired charging characteristics to the toner particles.

Any suitable spacer particles can be used. Examples of such spacer particles include latex or polymer spacer particles, alkyl tri-alkoxy silanes, and the like. Exemplary spacer particles include those disclosed in U.S. Pat. No. 7,452,646 and U.S. Patent Application Publication No. 2004-0137352 A1, the entire disclosures of which are incorporated herein by reference.

In one embodiment, the spacer particles are comprised of latex or polymer particles. Any suitable latex particles may be used without limitation. As examples, the latex particles may include rubber, acrylic, styrene acrylic, polyacrylic, fluoride, or polyester latexes. These latexes may be copolymers or crosslinked polymers. Specific examples include acrylic, styrene acrylic and fluoride latexes from Nippon Paint (e.g. FS-101, FS-102, FS-104, FS-201, FS-401, FS-451, FS-501, FS-701, MG-151 and MG-152) with particle diameters in the range from 45 to 550 nm, and glass transition temperatures in the range from 65° C. to 102° C. These latex particles may be derived by any conventional method in the art. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. In the latter case, the latex particles prepared may be classified so that the latex particles obtained have the appropriate size to act as spacers as discussed above. Commercially available latex particles from Nippon Paint have very narrow size distributions and do not require post-processing classification (although such is not prohibited if desired). Other examples of polymer particles that can be used to form the spacer particles include, for example, polymethyl methacrylate (PMMA), e.g., 150 nm MP1451 or 300 nm MP116 from Soken Chemical Engineering Co., Ltd. with molecular weights between 500 and 1500K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

In one embodiment, the spacer particles are large sized silica particles. Thus, the spacer particles have an average particle size greater than an average particle size of any other external additives used in the toner composition, such as silica and titania external additives. For example, the spacer particles in this embodiment are sol-gel silicas. Examples of such sol-gel silicas include, for example, X24, a 150 nm sol-gel silica surface treated with hexamethyldisilazane, available from Shin-Etsu Chemical Co., Ltd.

Alkyl tri-alkoxy silanes and alkyl tetra-alkoxy silanes can also be used as the spacer particles. Such silane materials can include, for example, mono-alkyl tri-alkoxy silane, di-alkyl di-alkoxy silane, and tri-alkyl mono-alkoxy silane, with 1-3 alkoxy groups of these tetra-alkoxy silane substituted by alkyl groups and their partial and total hydrolyzates. Examples of such silane materials include methyltrimethoxysilane, vinyltrimethoxysilane, tetramethoxysilane, methyltriethoxysilane, vinyltriethoxysilane, tetraethoxysilane, tetra-n-propoxy silane, tetra-i-propoxy silane, tetra-n-butoxy silane, tetra-sec-butoxy silane, tetra-tert-butoxy silane, and the like.

The spacer particles are treated with a charge control agent to provide the charge control agent-treated spacer particles. The treatment can be accomplished, for example, by simple mixing of the charge control agent with the spacer particles in a suitable solvent. In use, the charge control agent-treated spacer particles can remain in the original solvent, or the particles can be removed from the solvent (such as by drying) and re-dispersed in a surfactant.

Any desired charge control agent can be used to treat the spacer particles, consistent with the desired properties of the toner composition. Exemplary charge control agents include those disclosed in U.S. Pat. Nos. 3,944,493; 4,007,293; 4,079,014; 4,394,430, 4,560,635, and 7,833,684, the disclosures of which are totally incorporated herein by reference, and the like.

Examples of suitable charge control agents include quaternary ammonium compounds inclusive of alkyl pyridinium halides; alkyl pyridinium compounds, including those disclosed in U.S. Pat. No. 4,298,672, the disclosure of which is hereby incorporated by reference in its entirety; organic sulfate and sulfonate compounds, including those disclosed in U.S. Pat. No. 4,338,390, the disclosure of which is hereby incorporated by reference in its entirety; cetyl pyridinium tetrafluoroborates, distearyl dimethyl ammonium methyl sulfate; aluminum salts such as BONTRON E84™ or E88™ (Hodogaya Chemical); zinc salts; combinations thereof and the like. Also suitable are triarylamines, such as those that have functional groups such as phenol groups, hydroxyl groups, thiol groups, carboxylic acid groups, sulfonic acid groups, amino groups, and/or combinations thereof. Examples of suitable triarylamines include, but are not limited to, N,N'-diphenyl-N,N'-bis(3-hydroxyphenyl)-[1',1'-biphenyl]-4,4'-diamine (DHTBD); N,N-bis(p-methylphenyl), N-(4-hydroxylphenyl)amine; N,N-bis(p-methylphenyl),N-(4-carboxyphenyl)amine; N,N-bis(4-hydroxylphenyl), N-(4-methylphenyl)amine; 5-(N,N-bis(4-methylphenyl)amino) salicylic acid; Tris(4-hydroxylphenyl)amine; N-(4-methylphenyl), N-(4-hydroxylphenyl), N-(3-carboxy, 4-hydroxylphenyl)amine; N-(4-hydroxylphenyl),N-(4-carboxyphenyl), N-(3-carboxy, 4-hydroxylphenyl)amine; Tris(4-carboxyphenyl)amine; N-(2-methhyl, 4-hydroxylphenyl),N-(3-methyl, 4-carboxyphenyl), N-(3-carboxy, 4-hydroxylphenyl)amine; N,N'-bis(4-ethylphenyl)-N,N'-bis(3-carboxyl 4-hydroxylphenyl)[1,1'-biphenyl]-4,4'-diamine; N,N'-bis(4-methylphenyl)-N,N-bis(4-hydroxylphenyl)[1,1-biphenyl]-4,4'-diamine; N,N'-bis(1,1-biphenyl)-N,N'-bis(3-carboxy, 4-hydroxylphenyl)[1,1'-biphenyl]-4,4'-diamine; N,N'-bis(4-ethylphenyl)-N,N'-bis(3-methyl, 4-hydroxylphenyl)[1,1'-biphenyl]-4,4'-diamine; N,N'-bis(3-methylphenyl, 4-carboxy)-N,N'-bis(3-carboxyphenyl)[1,1'-biphenyl]-4,4'-diamine; N,N'-bis(3,4-dimethylphenyl)-N,N'-bis(3-carboxy, 4-hydroxylphenyl)[1,1'-biphenyl]-4,4'-diamine; N,N'-bis(3-methylphenyl)-N,N-bis(3-carboxyphenyl)[1,1'-biphenyl]-4,4'-diamine; N,N'-bis(3-methylphenyl, 4-carboxy)-N,N'-bis(3-carboxy, 4-hydroxylphenyl)[1,1'-biphenyl]4,4'-diamine; N,N-diphenyl-N,N'-bis(3-hydroxylphenyl)[p-terphenyl]-4,4'-diamine; N,N-diphenyl-N-(3-carboxymethylphenyl),N'-(3-carboxyethylphenyl)[1,1'-biphenyl]-4,4'-diamine; N,N'-diphenyl-N,N'-bis(3-hydroxyl, 4-carboxyphenyl)[p-terphenyl]-4,4'-diamine; N,N'-bis(3-hydroxylphenyl)-N,N'-bis(3-nitrophenyl)[1,1'-biphenyl]-4,4'-diamine; derivatives of the foregoing, and combinations thereof.

In embodiments, the charge control agent-treated spacer particles can be formed using any combination of one or more charge control agent species and one or more spacer particle species, as desired. For example, one, two, three, four, or more charge control agent species and/or spacer particle species may be used.

Any suitable and desired amount of charge control agent can be used to provide the desired charging properties. For example, the charge control agents may be present in effective amounts of, for example, from about 0.001 to about 20 weight percent of the toner particle, such as from about 0.01 to about 10 weight percent of the toner particle.

The resultant charge control agent-treated spacer particles can have any suitable and desired size and shape. In embodiments, the charge control agent-treated spacer particles are generally spherical and have an average particle size or diameter of from about 50 to about 1500 nm, such as from about 100 to about 1200 nm, or from about 200 to about 900 nm.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology. The conventional processes are modified only to provide for incorporation of the charge control agent-treated spacer particles such that those particles cause protrusions from the toner particle surface.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resins. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 8000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although the amounts can be outside of these ranges. This provides a sufficient amount of agent for aggregation.

The gloss of a toner may be influenced by the amount of retained metal ion, such as $Al^{3+}$, in the particle. The amount of retained metal ion may be further adjusted by the addition of materials such as EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Formation

In embodiments, a shell is applied to the formed aggregated toner particles. Any resin described above as suitable for the core resin may be utilized as the shell resin, although amorphous resins are desired, in embodiments. The shell resin may be applied to the aggregated particles by any method within the purview of those skilled in the art. In embodiments, the shell resin may be in an emulsion including any surfactant described above. The aggregated particles described above may be combined with the emulsion so that the resin forms a shell over the formed aggregates. In embodiments, an amorphous polyester may be utilized to form a shell over the aggregates to form toner particles having a core-shell configuration.

The resin emulsion used in the shell-formation process generally includes particles having a size of from about 100 nm to about 260 nm, in embodiments from about 105 nm to about 155 nm, or about 110 nm, and generally has a solids loading of from about 10% solids by weight to about 50% solids by weight, in embodiments from about 15% solids by weight to about 40% solids by weight, in embodiments about 35% solids by weight. Of course, other emulsions can also be used.

During the shell formation process, at any desires point, the charge control agent-treated spacer particles can be incorporated onto the shell, with completion of the shell formation. This incorporation can be conducted by adding the charge control agent-treated spacer particles into the shell-forming emulsion, where the charge control agent-treated spacer particles can be added directly into the emulsion, or desirably a solution or emulsion containing the charge control agent-treated spacer particles is added to the shell-forming emulsion.

In order to provide desired particle morphology, the addition of the charge control agent-treated spacer particles to the shell-forming emulsion can be conducted at any time during the shell-forming process. For example, the charge control agent-treated spacer particles can be added together with the shell-forming emulsion to form a shell, or the charge control agent-treated spacer particles can be added when the shell thickness has reached from about 10 to about 80% of the target shell thickness. Adjusting the addition time adjusts a depth at which the charge control agent-treated spacer particles are buried into the shell of the toner particles, and thus likewise an extent to which the charge control agent-treated spacer particles cause protrusions from the toner particle surface following shell completion.

Once the desired final size of the toner particles is achieved, the pH of the mixture may be adjusted with a base to a value of from about 6 to about 10, and in embodiments from about 6.2 to about .9.2 The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 95° C., in embodiments about 90° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, separate from the charge control agent-treated spacer particles described above, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/gm to about −45 μC/gm, in embodiments from about −10 μC/gm to about −40 μC/gm, and a final toner charging after surface additive blending of from −10 μC/gm to about −45 μC/gm. In embodiments, the toner particles may possess a parent toner charge per mass ratio (Q/M) of above about 35 μC/gm in A-zone (80° F., 80-85% relative humidity), such as about 35 μC/gm to about 80 μC/gm; above about 65 μC/gm in B-zone (70° F., 50% relative humidity), such as about 65 μC/gm to about 100 μC/gm; and above about 80 μC/gm in J-zone (70° F., 10% relative humidity), such as about 80 μC/gm to about 120 μC/gm.

Utilizing the methods of the present disclosure, desirable gloss levels may be obtained. Thus, for example, the gloss level of a toner of the present disclosure may have a gloss as measured by Gardner Gloss Units (ggu) of from about 10 ggu to about 100 ggu, in embodiments from about 50 ggu to about 95 ggu, in embodiments from about 15 ggu to about 65 ggu.

In embodiments, the dry toner particles, exclusive of external surface additives, may have the following characteristics:

(1) Volume average diameter (also referred to as "volume average particle diameter") of from about 2.5 to about 20 microns, in embodiments from about 2.75 to about 10 microns, in other embodiments from about 3 to about 9 microns.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.93 to about 0.99, in other embodiments from about 0.95 to about 0.98.

(4) Glass transition temperature of from about 45° C. to about 60° C.

(5) The toner particles can have a surface area, as measured by the well known BET method, of about 1.3 to about 6.5 $m^2/g$. For example, for cyan, yellow, magenta and black toner particles, the BET surface area can be less than 1 $m^2/g$, such as from about 0.8 to about 1.8 $m^2/g$.

It may be desirable in embodiments that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or by any optional wax. To achieve non-plasticization, it may be desirable to carry out the emulsion aggregation at a coalescence temperature of less than the melting point of the crystalline component and wax components.

Developers

In some embodiments, the toner particles may be used directly as a single component developer, i.e., without a separate carrier. In other embodiments, the toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover, which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the earlier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments, the fusing of the toner image can be conducted by any conventional means, such as combined heat and pressure fusing such as by the use of heated pressure rollers. In some embodiments, irradiation may also be utilized, for example, in the same fusing housing and/or step where conventional fusing is conducted, or it can be conducted in a separate irradiation fusing mechanism and/or step. In some embodiments, this irradiation step may provide non-contact fusing of the toner, so that conventional pressure fusing may not be required.

For example, in embodiments, the irradiation can be conducted in the same fusing housing and/or step where conventional fusing is conducted. In embodiments, the irradiation fusing can be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

In other embodiments, the irradiation can be conducted in a separate fusing housing and/or step from a conventional fusing housing and/or step. For example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

In other embodiments, the toner image can be fused by irradiation and optional heat, without conventional pressure fusing. This may be referred to, in embodiments, as noncontact fusing. The irradiation fusing can be conducted by any suitable irradiation device, and under suitable parameters, to cause the desired degree of crosslinking of the unsaturated polymer. Suitable non-contact fusing methods are within the purview of those skilled in the art and include, in embodiments, flash fusing, radiant fusing, and/or steam fusing.

In embodiments, non-contact fusing may occur by exposing the toner to infrared light at a wavelength of from about 800 to about 1000, in embodiments from about 800 to about 950, for a period of time of from 5 milliseconds to about 2 seconds, in embodiments from about 50 milliseconds to about 1 second.

Where heat is also applied, the image can be fused by irradiation such as by infrared light, in a heated environment such as from about 100 to about 250° C., such as from about 125 to about 225° C. or from about 150 or about 160 to about 180 or about 190° C.

Exemplary apparatuses for producing these images may include, in embodiments, a heating device possessing heating elements, an optional contact fuser, a non-contact fuser such as a radiant fuser, an optional substrate pre-heater, an image bearing member pre-heater, and a transfuser. Examples of such apparatus include those disclosed in U.S. Pat. No. 7,141,761, the disclosure of which is hereby incorporated by reference in its entirety.

When the irradiation fusing is applied to the toner composition, the resultant fused image is provided with non document offset properties, that is, the image does not exhibit document offset, at temperature up to about 90° C., such as up to about 85° C. or up to about 80° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item. Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

It is envisioned that the toners of the present disclosure may be used in any suitable procedure for forming an image with a toner, including in applications other than xerographic applications.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Charge control agent-treated spacer particles were formed as follows. 3% alkyl tri-alkoxy silane spacer particle average particle size or diameter of 500 nm) of the general structure

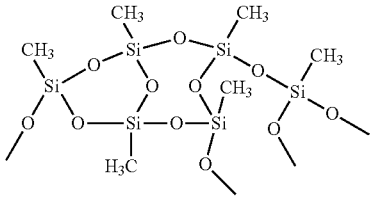

were placed in a 1% solution of aluminum 3,5-ditertiarybutyl salicylic acid and mixed until fully dispersed. The treated spacer particles were dried, such as by oven, rotary evaporator, freeze drier or other drying method. The result was charge control agent-treated spacer particles comprising the alkyl tri-alkoxy silane spacer particle with aluminum 3,5-ditertiarybutyl salicylic acid charge control agent particles on the silane particle surface.

Example 2

Toner particles containing the charge control agent-treated spacer particles were prepared as follows. The particles of Example 1 were re-dispersed in a solution of 1.5% sodium lauryl sulfate surfactant in deionized water. Emulsion/aggregation particles were made by first homogenizing styrene/butylacrylate resin latex with a pigment dispersion, a paraffin wax dispersion as well as polyaluminum chloride (PAC) at or around 20-30° C. The mixture was then heated to the temperature slightly below the Tg of the resin (45-65° C.) while mixing, to grow particle cores to the desired size (4.8-5.5 μm). The outer shell was then added and the appropriate particle size (depending upon target final particle size) was reached. ¾ of the shell was added, then ¼ of the shell with incorporated treated spacer of Example 1 was added. To prevent further growth of the particle after addition of the outer shell, sodium hydroxide solution was added and the temperature in the reactor was increased to obtain coalescence. At a circularity of 0.963-0.973, base was added to an increased pH and held for 20 minutes, then cooled. Particles were wet sieved, washed by filtration and dried. Care was taken to use less acid to avoid impacting the charge control agent. Resulting particles were then tested for charging by a bench procedure. Particles had the morphology shown in the FIGURE.

Comparative Example 1

Toner particles were formed as in Example 2, except that the charge control agent-treated spacer particles of Example 1 were replaced by untreated spacer particles (the same particles, but without charge control agent treatment).

Comparative Example 2

Toner particles were formed as in Example 2, except that the charge control agent-treated spacer particles of Example 1 were omitted.

Measurement of Charge with Additives

Samples of the toner particles of Example 2 and Comparative Examples 1 and 2 were tested for charging characteristics in A and B Zone. One sample was conditioned in the A-zone environment of 80° F., 80-85% RH, and the other was conditioned in the B-zone environment of 70° F., 50% RH. The samples were kept in the respective environments overnight to fully equilibrate. The following day the toners were charged by agitating the samples for 60 minutes in a Turbula mixer in their respective zone. The q/d charge on the toner particles was measured using a charge spectrograph. The toner charge was calculated as the midpoint of the toner charge trace from the CSG. Q/d is reported in millimeters of displacement from the zero line. The corresponding Q/d in μC/g was also measured for the sample. The results were as shown in the following Table.

| Description | A Zone (μC/gm) | B Zone (μC/gm) |
|---|---|---|
| Control | 24.03 | 79.7 |
| Tospearl on surface | 33.24 | 82.2 |
| CCA coated Tospearl on surface | 37.47 | 100.23 |

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner particle, the toner particle comprising:

a core; and a shell, wherein the shell comprises charge control agent-treated spacer particles that cause protrusions from the toner particle surface, wherein the spacer particles are selected from the group consisting of latex particles, polymer particles, and alkyl tri-alkoxy silane particles, and the charge control agent is about 0.001 to about 20 weight percent of the toner particle;

wherein the charge control agent-treated spacer particles are generally spherical and have an average diameter of about 50 to about 1500 nm;

wherein the toner particle accepts a particle charge of above about 35 μC/gm in an environment of 80° F. and 80-85% relative humidity, above about 65 μC/gm in an environment of 70° F. and 50% relative humidity, and above about 85 μC/gm in an environment of 70° F. and 10% relative humidity.

2. The toner particle of claim 1, wherein the spacer particles are latex particles comprising a material selected from the group consisting of rubber, acrylic, styrene acrylic, polyacrylic, and polyester.

3. The toner particle of claim 1, wherein the spacer particles are polymer particles comprising a material selected from the group consisting of polymethyl methacrylate, fluorinated polymethyl methacrylate, polyvinylidene fluoride, polytetrafluoroethylene, and melamine.

4. The toner particle of claim 1, wherein the spacer particles comprise a material selected from the group consisting of methyltrimethoxysilane, and methyltriethoxysilane.

5. The toner particle of claim 1, wherein the charge control agent is selected from the group consisting of quarternary ammonium compounds, organic sulfate and sulfonate compounds, cetyl pyridinium tetrafluoroborates, distearyl dimethyl ammonium methyl sulfate, aluminum salts, zinc salts, and triarylamines.

6. The toner particle of claim 1, further comprising at least one of a colorant, a wax, a curing agent, a charge additive, and a surface additive.

7. The toner particle of claim 1, wherein the toner particle is an emulsion/aggregation toner particle.

8. The toner particle of claim 1, wherein the toner particle has a minimum fusing temperature of from about 90° C. to about 140° C.

9. A method of making the toner particles of claim 1, the method comprising:

forming a slurry by mixing together a first emulsion containing a resin, optionally a wax, optionally a colorant, optionally a surfactant, optionally a coagulant, and one or more additional optional additives;

heating the slurry to form aggregated core particles in the slurry;

forming a shell on the aggregated core particles by adding to the slurry a second emulsion comprising a resin;

during the step of forming a shell, adding to the slurry charge control agent- treated spacer particles to form protrusions in the shell;

freezing aggregation of the particles by adjusting the pH;

heating the aggregated particles in the slurry to coalesce the particles into toner particles; and optionally washing and drying the toner particles, wherein the shell comprises charge control agent-treated spacer particles that cause protrusions from the toner particle surface, wherein the spacer particles are selected from the group consisting of latex particles, polymer particles, and alkyl tri-alkoxy silane particles, and the charge control agent is about 0.001 to about 20 weight percent of the toner particle;

the charge control agent-treated spacer particles are generally spherical and have an average diameter of about 50 to about 1500 nm; and the toner particle accepts a particle charge of above about 35 μC/gm in an environment of 80° F. and 80-85% relative humidity, above about 65 μC/gm in an environment of 70° F. and 50% relative humidity, and above about 85 μC/gm in an environment of 70° F. and 10% relative humidity.

10. The method of claim 9, wherein the charge control agent-treated spacer particles are added to the slurry in the step of forming a shell after a first portion of the shell has been formed, but before the complete shell is formed.

11. The method of claim 9, wherein the charge control agent-treated spacer particles are added to the slurry in the step of forming a shell after about 10 to about 80% of the shell has been formed.

12. The method of claim 9, wherein the charge control agent is selected from the group consisting of quarternary ammonium compounds, organic sulfate and sulfonate compounds, cetyl pyridinium tetrafluoroborates, distearyl dimethyl ammonium methyl sulfate, aluminum salts, zinc salts, and triarylamines.

13. The method of claim 9, wherein the charge control agent-treated spacer particles are formed by mixing spacer particles with a charge control agent in a solvent.

* * * * *